US009999270B2

(12) United States Patent
Washingon

(10) Patent No.: US 9,999,270 B2
(45) Date of Patent: Jun. 19, 2018

(54) PERSONAL HEAD AND NECK COOLING CAP

(71) Applicant: Earl James Washingon, Jackson, MS (US)

(72) Inventor: Earl James Washingon, Jackson, MS (US)

( * ) Notice: Subject to any disclaimer, the term of this patent is extended or adjusted under 35 U.S.C. 154(b) by 0 days. days.

(21) Appl. No.: 15/430,195

(22) Filed: Feb. 10, 2017

(65) Prior Publication Data

US 2018/0014596 A1 Jan. 18, 2018

Related U.S. Application Data

(60) Provisional application No. 62/362,638, filed on Jul. 15, 2016.

(51) Int. Cl.
*A42B 1/00* (2006.01)
*A42B 1/06* (2006.01)

(52) U.S. Cl.
CPC ..... *A42B 1/008* (2013.01); *A42B 1/062* (2013.01)

(58) Field of Classification Search
CPC ..... A42B 1/008; A42B 1/067; A42B 1/066; A42B 1/062; A42B 1/18; A42B 1/24; A42B 3/286; A42B 1/06; A42B 1/061; A42B 1/069; A42B 3/28; A42B 3/0486; A42C 5/04
USPC ..... 2/171.3, 195.1
See application file for complete search history.

(56) References Cited

U.S. PATENT DOCUMENTS 3,353,191 A 11/1967 Dahly
4,680,815 A 7/1987 Hirsch et al.
4,730,612 A * 3/1988 Dampney ..... A42B 3/286 128/201.24
7,143,451 B2 12/2006 Lundgren
2002/0035745 A1* 3/2002 Spell ..... A42B 1/008 2/209.13
2010/0017941 A1* 1/2010 Taylor ..... A42B 1/008 2/171.3
2014/0143934 A1* 5/2014 Grzybowski ..... A42B 3/286 2/171.3

(Continued)

FOREIGN PATENT DOCUMENTS

JP 3186431 U * 10/2013
WO WO 2006090677 A1 * 8/2006 ..... A41D 13/0025
WO WO 2015162695 A1 * 10/2015 ..... A42C 5/04

OTHER PUBLICATIONS

WO2015162695 English language translation, Espacenet, doc. published Oct. 2015, 28 pages.*

(Continued)

*Primary Examiner* — Amy Vanatta
(74) *Attorney, Agent, or Firm* — Clifford H. Kraft

(57) ABSTRACT

A head and neck cooling cap that has an air bag sewn to the back of the cap which extends below the wearer's collar line. The air bag contains a battery operated fan that fills the bag with air. The air is distributed over the cap's adjustable band to the top of the head. Air is also vented through vent grommets or other openings in the bag at the wearer's neck. The fan is equipped with a variable speed motor which runs from a battery pack or USB power pack. The batteries are typically worn in a pocket or other location on the user including a V-clip or possible battery belt or battery holder. The batteries can also be mounted in the bottom of the air bag.

12 Claims, 2 Drawing Sheets

(56) References Cited

U.S. PATENT DOCUMENTS

| | | | | |
|---|---|---|---|---|
| 2014/0150163 | A1* | 6/2014 | Hatton | A42B 1/008 2/171.3 |
| 2016/0157547 | A1* | 6/2016 | Ichigaya | A42B 3/286 2/422 |
| 2017/0231293 | A1* | 8/2017 | Ichigaya | A41D 13/0025 62/259.3 |

OTHER PUBLICATIONS

WO 2006090677 (PCT/JP2006/303005) English language transation, doc published Aug. 2006, 16 pages.*

* cited by examiner

PERSONAL HEAD AND NECK COOLING CAP

This application is related to and claims priority from U.S. Provisional patent application No. 62/362,638 filed Jul. 15, 2016. Application 62/362,638 is hereby incorporated by reference in its entirety.

BACKGROUND

Field of the Invention

The present invention relates generally to headwear and more particularly to a personal head and neck cooling cap.

Description of the Problem

Ball caps and the like exist in all colors, sizes and types. However, they all suffer from the same problem. They make the head perspire inside the cap causing the hair to become messy and causing great discomfort for the wearer especially if the cap is worn in the sun. It would be extremely advantageous to have a ball cap, or other headwear, that could overcome these disadvantages keeping the user's head and neck cool.

There are some hats with fans in the art; they include Dahly, U.S. Pat. No. 3,353,191, Hirsch et al., U.S. Pat. No. 4,680,815 and Lundgren, U.S. Pat. No. 7,143,451. These inventions only blow air into the hat from a fan mounted on the hat or in the hat.

SUMMARY OF THE INVENTION

The present invention is a head and neck cooling all purpose cap that has an air bag sewn to the back of the cap which extends below the wearer's collar line. This air bag contains a battery operated fan that fills a bladder in the bag with air. The air is distributed over the cap's adjustable band to the top of the head. Air is also vented through vent grommets or other openings in the bag at the wearer's neck to cool the neck. The fan is equipped with a variable speed motor which runs from a battery pack or USB power pack. The batteries are typically worn in a pocket or other location on the user including a V-clip or possible battery belt or battery holder. The batteries can also be mounted in the bottom of the air bag.

DESCRIPTION OF THE FIGURES

Attention is now directed to several figures that illustrate features of the present invention.

Several drawings and illustrations have been presented to aid in understanding the present invention. The scope of the present invention is not limited to what is shown in the figures.

DESCRIPTION OF THE PREFERRED EMBODIMENTS

Figure 1:
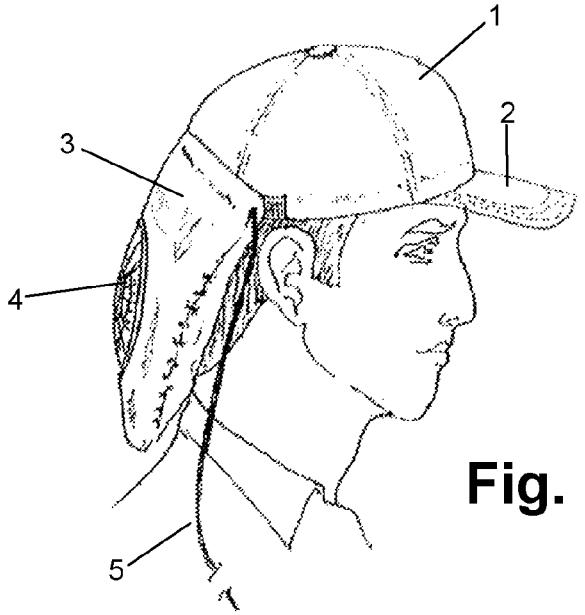
FIG. 1 is a side view of an embodiment of the present invention being worn.

The present invention relates to a personal cap or hat that includes a rear-mounted air bag that is filled by a battery-powered fan. The cap is constructed so that air flows over the wearer's head and around his neck. FIG. 1 shows a side view of an embodiment of the present invention.

A standard ball cap 1 with a bill 2 has an air bag 3 sewed to it just above the adjustable band. The air bag 3 contains an air bladder and hangs down around the user's neck in the rear. A battery-powered fan 4 is mounted in the rear face of the air bag 3. The air bag 3 is constructed, and interfaces with the cap 1 in such a way that air flows up over the band of the cap and over the wearer's head. The air bag 3 also has grommets or other openings (shown in FIG. 3) that allow air to escape around the neck of the wearer. The net effect is a cooling of both the head and neck of the wearer. This leads to much greater comfort for the head preventing excessive perspiration and wetting of the hair. FIG. 1 also shows a cord or cable 5 descending toward the wearer's chest. This is a battery cable.

Figure 2:
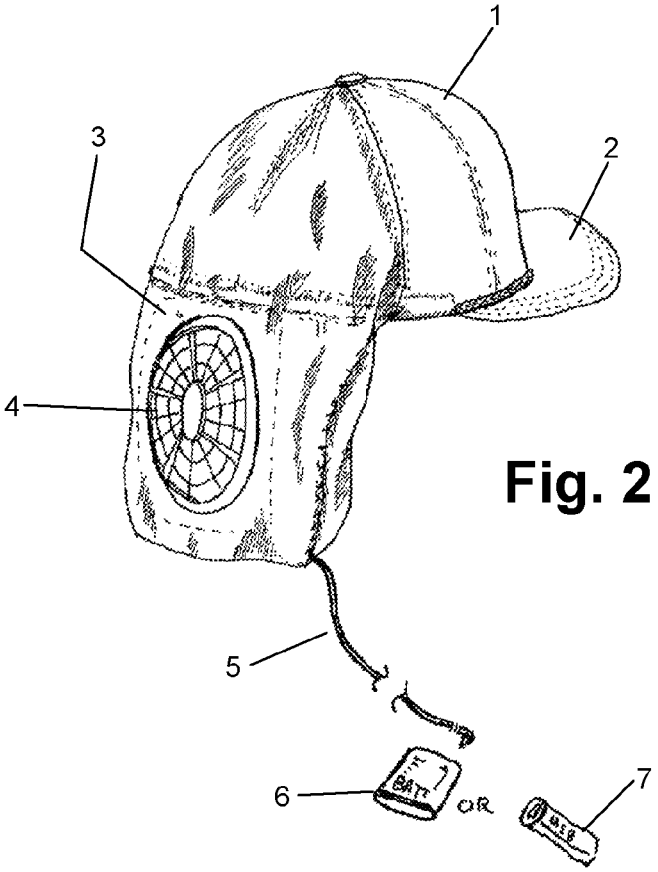
FIG. 2 is a back perspective view of the embodiment of FIG. 1.

FIG. 2 is a rear-side perspective view of the embodiment of FIG. 1. Similar features are shown including the cap 1 and the bill or visor 2. The air bag 3 can be see in more detail. The outer covering of the air bag 3 can be made of a material that is the same or similar to that of the cap 1. There is an air bladder inside the bag 3 that is inflated or blown up by the fan 4. The fan 4 can be a variable speed fan allowing the user to select a desired amount of air flow. As previously stated, the air bag 3 is attached to the cap 1 in such a way to allow air to flow over the wearer's head in an amount selectable by the fan speed. As also stated, additional cooling air can exit specially designed grommets or openings to flow around the wearer's neck. These two air flows can provide total comfort. FIG. 2 also shows a battery 6 or Universal Serial Bus (USB) power pack 7. One of these can attach to the power cable 5 that powers the fan.

Figure 3:
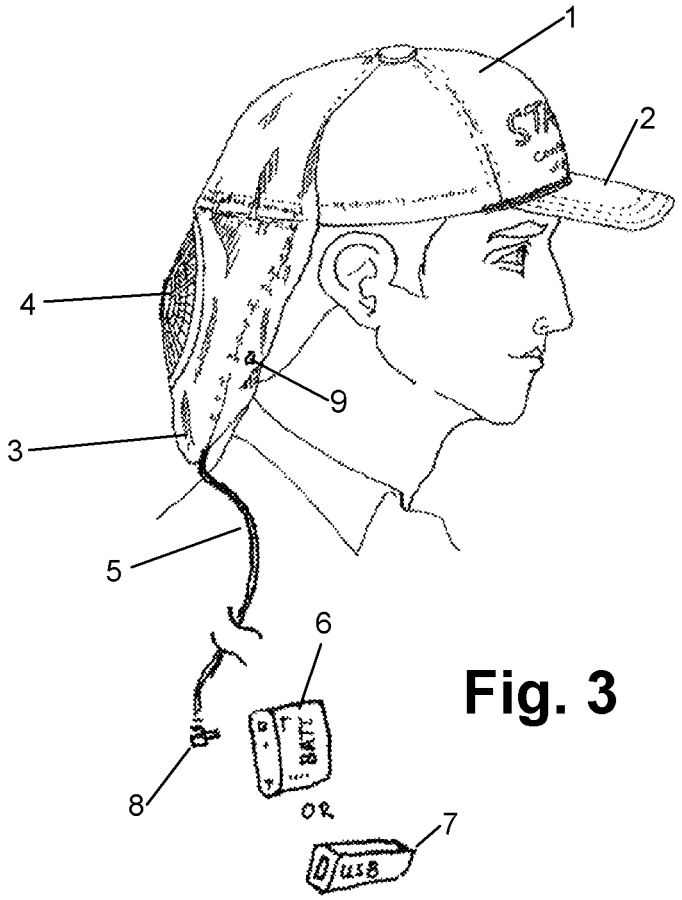
FIG. 3 is another side view showing the battery or USB power pack.

FIG. 3 shows another side view of an embodiment of the invention. Similar features can be seen. The air bag 3 has several grommets or other openings 9 that allow air flow over the neck. FIG. 3 also shows a battery pack plug 8 on the end of the battery cable 5.

The present invention is a novel solution to the problem of the extreme heat one feels while wearing a conventional ball cap or other hat, especially in the sun. The invention cools both the head and the neck in a controlled manner using the variable speed fan.

Several descriptions and illustrations have been presented to aid in understanding the present invention. One with skill in the art will realize that numerous changes and variations may be made without departing from the spirit of the invention. Each of these changes and variations is within the scope of the present invention.

I claim:

1. A personal cooling hat comprising:

a cap having a head-covering portion and a front-protruding bill;

an air bag of sewable material having a top, bottom, back side and front side sewed to the rear of the cap, the air bag having a separate internal inflatable bladder positioned so that air can exit the top of the air bag and flow into the head-covering portion over a wearer's head;

a fan attached to the back side of the air bag constructed to inflate the air bag inflatable bladder with ambient air;

a plurality of openings in the front side of the air bag one third distance from the bottom of the bag constructed to cause air to also flow out of the air bag around a wearer's neck region.

2. The personal cooling hat of claim 1 wherein the fan is a variable speed fan.

3. The personal cooling hat of claim 1 wherein the fan is battery powered.

4. The personal cooling hat of claim 3 further comprising a battery to power the fan.

5. The personal cooling hat of claim 4 wherein the battery is external to the hat.

6. The personal cooling hat of claim 1 further comprising a USB power pack constructed to power the fan.

7. The personal cooling hat of claim 1 wherein the head covering portion of the cap has a front and rear, and the top of the air bag is sewed to the rear of the head covering portion.

8. The personal cooling hat of claim 1 wherein the plurality of openings contain grommets.

9. A cooling hat comprising:

a cap having a head-covering portion and a front-protruding bill;

an air bag of sewable material having a top, bottom, back side and front side sewed to the rear of the cap, the air bag having a separate internal inflatable bladder positioned in the air bag so that air can exit the bladder and top of the air bag and flow into the head-covering portion of the hat over a wearer's head;

a fan attached to the back side of the air bag constructed to inflate the inflatable bladder with ambient air;

a plurality of openings in the front side of the air bag one third distance from the bottom of the bag constructed to cause air to also flow out of the air bag around a wearer's neck region;

an external battery adapted to power the fan, the external battery having a universal serial bus (USB) charging port;

wherein the external battery is carried in a pocket or on a belt.

10. The cooling hat of claim 9 wherein the plurality of openings contain grommets.

11. The cooling hat of claim 9 further comprising a cable between the external battery and the cooling hat, wherein the cable includes a plug constructed to allow removal of the battery.

12. The cooling hat of claim 9 wherein the fan is variable speed.

* * * * *